United States Patent [19]

Willcocks

[11] 4,063,032

[45] Dec. 13, 1977

[54] CONSTANT POWER BALANCE CONTROLS FOR STEREOPHONIC AND QUADRAPHONIC SOUND SYSTEMS

[75] Inventor: Martin Edmund George Willcocks, Somersham, England

[73] Assignees: John C. Bogue, Santa Monica; Wesley Ruggles, Jr., Beverley Hills, both of Calif.

[21] Appl. No.: 667,455

[22] Filed: Mar. 16, 1976

[51] Int. Cl.[2] ..... H04R 5/00

[52] U.S. Cl. ..... 179/1 GQ; 179/1 G; 179/1 VL

[58] Field of Search ..... 179/1 GQ, 1 G, 1 VL, 179/15 BT, 100.1 TD, 100.4 ST

[56] References Cited

U.S. PATENT DOCUMENTS

| | | | |
|---|---|---|---|
| 3,725,583 | 4/1973 | Gunderson et al. | 179/1 VL |
| 3,769,459 | 10/1973 | Niffenegger et al. | 179/1 VL |
| 3,849,601 | 11/1974 | Goncharoff | 179/1 VL |
| 3,937,885 | 2/1976 | Gay | 179/1 GQ |

*Primary Examiner*—Douglas W. Olms
*Attorney, Agent, or Firm*—Witherspoon, Lane & Hargest

[57] ABSTRACT

Constant power balance control systems for stereophonic and quadraphonic sound systems are disclosed. Three different embodiments of the invention are disclosed. The first embodiment is a resistive network having a plurality of fixed resistors and a linear potentiometer. The second embodiment is a solid state circuit having four pairs of transistors. The transistors of each transistor pair are chosen to have characteristics such that for the same base-to-emitter voltage, the collector currents of the transistors of each pair satisfy a given ratio. The third embodiment is a combination of the first two embodiments. The third embodiment provides a comprehensive quadraphonic gain and balance control system.

5 Claims, 3 Drawing Figures

CONSTANT POWER BALANCE CONTROLS FOR STEREOPHONIC AND QUADRAPHONIC SOUND SYSTEMS

BACKGROUND OF THE INVENTION

This invention relates to balance control systems and more particularly to constant power balance control systems for stereophonic and quadraphonic sound systems.

SUMMARY OF THE INVENTION

The invention is intended for use in a stereophonic or quadraphonic sound system, and is a form of two channel balance control, so devised that with a single track linear potentiometer as the external control, an approximately sine-cosine balance law is obtained, with approximately constant total power in the two channels. Two particular implementations are described, one of which could form part of an integrated circuit, and the other for use with discrete components. A further implementation combines these versions into a comprehensive quadraphonic gain and balance control system.

BRIEF DESCRIPTION OF THE DRAWING

A complete understanding of the invention can be obtained from the following detailed description when read in conjunction with the annexed drawings in which.

DETAILED DESCRIPTION OF THE INVENTION

Figure 1:
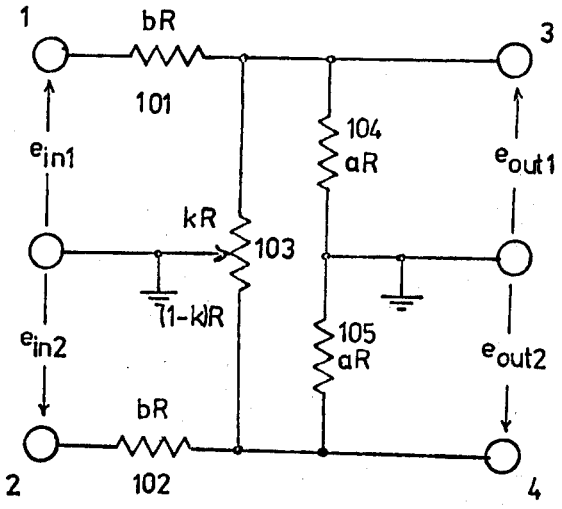
FIG. 1 is a schematic diagram of the resistive embodiment of the invention.

Referring to FIG. 1, the circuit comprises the fixed resistors 101 and 102, the variable linear potentiometer 103 and the fixed resistors 104 and 105. Signals $e_{in1}$ and $e_{in2}$ are applied to terminals 1 and 2 respectively, and after attenuation by the balance control network, output signals $e_{out1}$ and $e_{out2}$ appear at terminals 3 and 4 respectively. If the value of the potentiometer 103 is R, then there are optimum choices of resistor values for resistors 101, 102, 104 and 105. Let the values of resistors 104 and 105 each be equal to $a$R where $a$ is a constant, and let the values of resistors 101 and 102 each be $b$R, where $b$ is a second constant. Then, if a fraction $k$ of potentiometer R is between terminal 3 and the ground terminal and a fraction $1-k$ is between terminal 4 and ground, the transmission factor of the upper network comprising resistors 101,104 and the fraction $k$ of potentiometer 103 is given by $$\frac{e_{out1}}{e_{in1}} = c\,\frac{1-x}{1.414+0.586x} \tag{1}$$

and that of the lower network by $$\frac{e_{out2}}{e_{in2}} = c\,\frac{1+x}{1.414+0.586x} \tag{2}$$

where $$x = 1 - 2k \tag{3}$$

$$c = 0.414/b \tag{4}$$

and optimized choice of $b$ in terms of $a$ is $$b = a/1.414a - 1 \tag{5}$$

or alternatively the optimized choice of $a$ in terms of $b$ is $$a = b/1.414b - 1 \tag{6}$$

Either $a$ or $b$ may be chosen arbitrarily and the other is fixed by equations 5 or 6, also both $a$ and $b$ must be greater than 0.707. Furthermore the attenuation of the network at the central position of the potentiometer must be greater than 7.7 dB.

Figure 2:
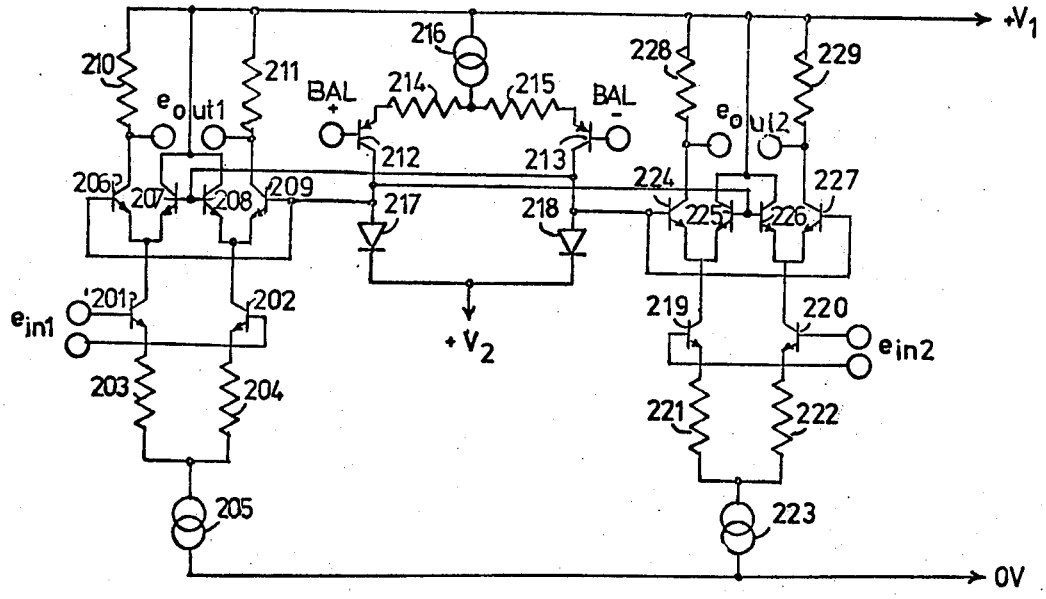
FIG. 2 is a schematic diagram of the transistorized solid state embodiment of the invention.

FIG. 2 shows in detail an alternative form of the balance control which does not have this disadvantage, and which is suitable for use as part of an integrated circuit. Transistors 212 and 213, resistors 214 and 215 and current source 216 form a balanced differential amplifier, the output current of which is used to develop a voltage across each of the forward biased diodes 217 and 218. Similar amplifiers comprising elements 201 through 205 and 219 through 223 supply balanced currents to the multipliers comprising transistors 206 through 209 and 224 through 227. These transistors are chosen to have different characteristics such that for the same base-to-emitter voltage, the collector currents of transistors 206 and 207 are in the ratio 2.414:1. Thus in each of the pairs 206 and 207, 208 and 209, 224 and 225, 226 and 227, precisely 0.293 of the signal current is diverted to the supply when the voltages across the diodes 217 and 218 are equal. If the unbalance current in the amplifier 212 through 216 is a fraction $x$ of the total flowing, then the attenuation of circuit 201 through 211 is given by the same formula as equation (1) and that of circuit 219 through 229 by equation (2), with the exception that if resistors 203, 204, 210 and 211 all have the same value, and resistors 221, 222, 228 and 229 all have the same value of $c$ is 1.

Table 1 below lists the performance of the balance control in terms of the parameter $x$, from which it can be seen that a very good approximation to a constant power law is obtained. The attenuations of the first and second signals are $a_1$ and $a_2$ respectively, the angle $\theta$ is the apparent direction angle of a center source, and F is the total power.

| x | $a_1$ | $a_2$ | $\theta$ deg | P d3 |
|---|---|---|---|---|
| 0.0 | 0.7071 | 0.7071 | 0 | 0 |
| 0.1 | 0.7469 | 0.6639 | 3.3 | −0.00 |
| 0.2 | 0.7836 | 0.6168 | 6.7 | −0.01 |
| 0.3 | 0.8176 | 0.5652 | 10.3 | −0.04 |
| 0.4 | 0.8492 | 0.5085 | 14.1 | −0.08 |
| 0.5 | 0.8787 | 0.4459 | 18.0 | −0.13 |
| 0.6 | 0.9062 | 0.3764 | 22.4 | −0.16 |
| 0.7 | 0.9319 | 0.2988 | 27.2 | −0.18 |
| 0.8 | 0.9560 | 0.2115 | 32.5 | −0.18 |
| 0.9 | 0.9787 | 0.1127 | 38.4 | −0.13 |
| 1.0 | 1.0000 | 0.0000 | 45.0 | 0.00 |

Furthermore, the directional characteristics are nearly linear in placing a center source to right or left as the balance control is rotated.

Figure 3:
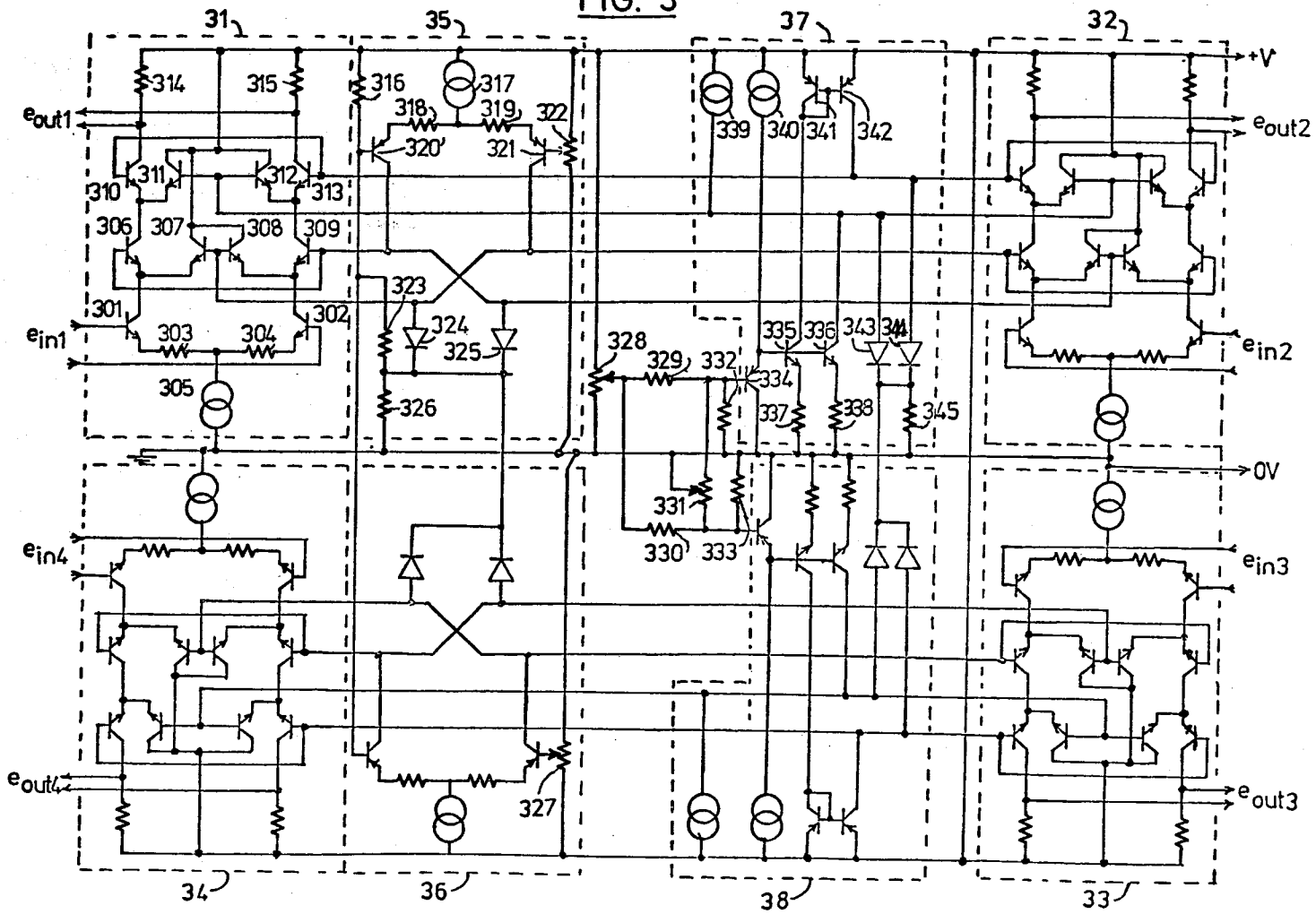
FIG. 3 is a schematic diagram of a third embodiment of the invention which is a combination of the resistive embodiment and the transistorized solid state embodiment.

In another implementation, the circuit of FIG. 1 may be used to generate two d.c. voltages from a fixed d.c. voltage applied to both inputs 1 and 2. The resulting output d.c. voltages appearing at terminals 3 and 4 may be used as inputs to a multiplying circuit, which multiples the a.c. signal voltages by these d.c. voltages to give output a.c. voltages attenuated according to equations (1) and (2) with the value of $c$ equal to 1, thereby eliminating the disadvantage of the minimum 8dB loss referred to above. Furthermore, if the fixed d.c. voltage is supplied from the output of a potentiometer across the supply voltage, the value of this voltage may be varied to adjust the gain of the multiplier. FIG. 3 shows how this idea may be combined with the second implementation described above in a quadraphonic gain and balance control combination which has close to ideal characteristics, and is usable as part of an integrated circuit.

Referring now to FIG. 3, the four input signals are applied in push-pull to each of four pairs of input terminals labelled $e_{in1}$, $e_{in3}$ and $e_{in4}$ respectively. Each of the four signal processing blocks labeled 31, 32, 33 and 34 is identical in character and performance, and similar in form to the circuitry shown in FIG. 2, and the output voltages appear at the terminals labeled $e_{out1}$, $e_{out2}$, $e_{out3}$, and $e_{outM}$ respectively. Referring to the signal processing block labeled 31 specifically, this consists of an input stage comprising transistors 301 and 302, resistors 303 and 304 and current sink 305. This balanced differential amplifier operates in the same manner as that described above, and produces at the collectors of transistors 301 and 302 two output currents which have signal components in antiphase and also direct current components. These currents are then split by the pairs of transistors 306 and 307, and 308 and 309, in the manner described previously, transistors 306 and 307 having current ratios of 2.414:1 and transistors 308 and 309 having current ratios of 1:2.414. Thus in each pair, 0.293 of the total current is diverted to the +V supply, and the remaining 0.707 of the total current is coupled to the emitters of the pairs of transistors 310 and 311, and 312 and 313 respectively. These pairs also have a current-splitting function and divert a proportion of the signal current into the +V supply, the remainder being used to develop a signal output voltage across resistors 314 and 315, which appears at the output terminals in push-pull. Transistors 310 and 311, and 312 and 313 have equal areas so that their collector currents are equal when they have the same base-to-emitter voltage.

The lower pairs of transistors 306 and 307, 308 and 309 of signal processing block 31 and the corresponding transistor pairs of block 32 are driven by a balance control circuit like that shown in FIG. 2. This comprises the differential amplifier consisting of transistors 320 and 321, resistors 318 and 319 and current source 317, together with the associated biasing circuitry and the diodes 324 and 325. The chain of resistors 316, 323 and 326 provide a fixed voltage at the base of transistor 320 and the voltage shown as $+V_2$ in FIG. 2, and is common to the identical block of circuitry labelled 36. Potentiometer 322 provides a variable voltage to drive the base of transistor 321, and this potentiometer forms the balance control between channels 1 and 2. Potentiometer 327 likewise forms the balance control between channels 3 and 4, the block of circuitry labelled 36 being identical in form and operation to that labelled 35 just described. The drive voltages to the pairs of transistors in blocks 31 and 32 are applied in opposite senses so that as potentiometer 322 is rotated the gain of signal processor 31 increases as that of 32 decreases in accordance with the equations (1) and (2).

The upper pairs of transistors 310 and 311, and 312 and 313 of block 31 and the corresponding transistors in block 32 are driven by the block of circuitry labelled 37, which is a gain control circuit. Potentiometer 328 controls the gain of all four channels, as will be described below. The input network comprising resistors 329, 330, 322 and 333 and potentiometer 331 form a balance control in the configuration of FIG. 1, and provides at its output terminal a pair of direct voltages related to the voltage at the slider of potentiometer 328 by equations (1) and (2) where the value of c may be chosen for convenient operation of the following circuit. Transistors 334, 335 and 336 with resistors 337 and 338 form a linear voltage-to-current converter, which develops a pair of output currents at the collectors of transistors 335 and 336 proportional to the input voltage at the base of transistor 334. Transistors 341 and 342 form a current mirror such that the current flowing in the collector of transistor 342 is equal to that flowing in the collector of transistor 341 and hence equal to that flowing in transistor 335. The collector current of transistor 342 is applied to diode 344 and develops a voltage across it proportional to the logarithm of the current. The collector current of transistor 336, which is equal to that of transistor 335, is subtracted from a fixed current supplied by current source 339 and applied to diode 343. Thus the sum of the currents flowing in diodes 343 and 344 is constant and their ratio depends in a linear manner on the input voltage applied to the base of transistor 334. The sum of these currents, and their counterparts in block 38, are applied to resietor 345 to provide a fixed return voltage for the cathodes of diodes 343 and 344 and their counterparts in block 38, which voltage should be higher than that at the junction of resistors 323 and 326 for correct operation of the circuit. The voltages appearing at the anodes of diodes 343 and 344 are used to drive transistor pairs 310 and 311, and 312 and 313 of block 31 and their counterparts in block 32 in the same sense, such that the ratio of the currents in transistors 310 and 311 is always equal to the ratio of the currents in diodes 344 and 343 respectively. Consequently, as the voltage at the input of transistor 334 rises, the gain of processors 31 and 32 also rises in exactly the same proportion. By suitable choice of the values of current source 339, resistors 337 and 338 and the network 329 through 333, the gain may be made to vary between zero and maximum when potentiometer 328 is rotated. The performance of circuit block 38 is similar to that of block 37, so that the gains of all four channels are varied in proportion, without affecting the balance between the channels, which are determined by potentiometers 322, 327 and 331. If channels 1 and 2 are the left front and right front channels of a quadraphonic sound system, and channels 3 and 4 are the left back and right back channels, then potentiometer 322 controls the left front-right front balance, potentiometer 327 controls the left back-right back balance and potentiometer 331 controls the balance between the front pair and back pair of channels, while potentiometer 328 controls the gain of all four channels in unison. This configuration has particularly desirable characteristics, as the balance controls each operate without affecting the overall sound level in the room, provided that the four channels have roughly similar sound content, and the grouping of the balance controls has been found convenient by users of such systems.

What is claimed is:

1. In apparatus for reproducing on two loudspeaker the audio signals contained in two independent channels, a balance control circuit comprising:

first and second differential voltage-to-current converters each having a pair of input terminals to which the respective one of said first and second audio input signals is applied differentially, and a pair of output terminals, and being operative to provide at its output terminals a pair of output currents having equal direct current components and equal signal current components in antiphase, first, second, third and fourth current-splitting means, each having an input terminal, a first and a second output terminal, a first and a second control terminal, and being operative to split any current flowing through its input terminal into a first output current at its first output terminal and a second output current at its second output terminal in a predetermined constant ratio dependent on the voltage applied between its first and second control terminals, the input terminals of said first and second current-splitting means being connected respectively to the first and second output terminals of said first differential voltage-to-current converter and the input terminals of said third and fourth current-splitting means being connected respectively to the first and second output terminals of said second differential voltage-to-current converter, first, second, third and fourth load resistors respectively connected between said first output terminal of said first, second, third and fourth current-splitting means and a common signal ground terminal, said second output terminal of each of said first, second, third and fourth current-splitting means being connected directly to said common signal ground terminal, said first control terminals of said first and second current-splitting means being connected together with said second control terminals of said third and fourth current-splitting means to a common first control terminal, and said second control terminals of said first and second current splitting means being connected together with said first control terminals of said third and fourth current-splitting means to a common second control terminal, the first output audio signals from the balance control circuit being taken differentially between said first output terminals of said first and second current-splitting means and the second output audio signal being taken differentially between said first output terminals of said third and fourth current-splitting means, each of said current-splitting means being configured to split the input current applied to its input terminal into two output currents in a ratio determined by the control voltage applied between its first and second control terminals, the fraction of the input current which appears at the first output terminal being approximately equal to $(1 + x)/(1.414 + 0.586x)$ where $x$ is the ratio of the control voltage applied between the first and second control terminals to the maximum value of control voltage which may be applied thereto, and $x$ may be varied between $-1$ and 1 by varying the control voltage, the whole circuit being operative to provide at its differential outputs first and second audio output signals which are identical in content to said first and second input signals respectively but are amplified or attenuated by different factors depending on the applied control voltage such that if equal input signal voltages are applied to said first and second voltage-to-current converters the r.m.s. sum of the output signal voltages is maintained substantially constant irrespective of the applied control voltage.

2. Apparatus according to claim 1 in which each of said current-splitting means comprises first and second transistors having different characteristics such that for equal base-to-emitter voltages their collector currents are in the ratio of 2.414 to 1, the collector of said first transistor being connected to said first output terminal and the collector of said second transistor being connected to said second output terminal, the bases of said first and second transistors being connected each to the anode of a diode, the cathodes of both diodes being connected to a fixed voltage and the anodes of said diodes being driven by the two outputs of a differential voltage-to-current converter whose input terminals are said first and second control terminals of said current-splitting means.

3. Apparatus according to claim 1 in which said voltage-to-current converter and said two diodes are common to both current-splitting means and are connected to vary the balance between said first and second audio signals.

4. Apparatus according to claim 6 in which said voltage-to-current converter and said two diodes are common to both current-splitting means and are connected to vary the balance between said first and second audio signals.

5. In apparatus for reproducing on four loudspeakers the audio signals contained in four independent channels, a comprehensive gain and balance control circuit comprising:

first, second, third and fourth input terminals to which said four audio signals are respectively applied, a first balance circuit connected to balance said first and second signals, a second balancing circuit connected to balance said third and fourth signals, a third balancing circuit connected to balance said first and third signals, a fourth balancing circuit connected to balance said second and fourth signals, said third and fourth balancing circuits being connected to a single means for generating first and second control voltages, said means for generating said first and second control voltages being connected to a variable d.c. voltage, the whole circuit including a first balancing potentiometer connected to the first balancing circuit and operative to vary the balance between said first and second channels, a second balancing potentiometer connected to the second balancing circuit, and operative to vary the balance between said third and fourth channels, a third balancing potentiometer forming part of said means for generating said first and second control voltages and operative to vary the balance between said first and second control voltages, and a gain control potentiometer, operative to provide a variable d.c. voltage to the d.c. input terminal of said means for generating said first and second control voltages thereby varying the gain of all four channels simultaneously without affecting the balance between any pair of the four channels.

* * * * *